US012779519B2

(12) United States Patent
Wang et al.

(10) Patent No.: US 12,779,519 B2
(45) Date of Patent: Nov. 3, 2026

(54) FREE BENDING FORMING DEVICE HAVING VARIABLE LENGTH OF BENDING DEFORMATION ZONE CAPABLE OF PROCESSING TUBES OF DIFFERENT OUTER DIAMETERS

(71) Applicant: ZHEJIANG UNIVERSITY, Hangzhou (CN)

(72) Inventors: Zili Wang, Hangzhou (CN); Yongzhe Xiang, Hangzhou (CN); Shuyou Zhang, Hangzhou (CN); Jianrong Tan, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 0 days.

(21) Appl. No.: 19/120,756

(22) PCT Filed: Oct. 12, 2024

(86) PCT No.: PCT/CN2024/124369
§ 371 (c)(1),
(2) Date: Apr. 11, 2025

(87) PCT Pub. No.: WO2025/167169
PCT Pub. Date: Aug. 14, 2025

(65) Prior Publication Data

US 2026/0001115 A1 Jan. 1, 2026

(30) Foreign Application Priority Data

Feb. 6, 2024 (CN) ..... 202410168428.0

(51) Int. Cl.
*B21D 7/02* (2006.01)
*B21D 43/00* (2006.01)

(52) U.S. Cl.
CPC ..... *B21D 7/02* (2013.01); *B21D 43/003* (2013.01)

(58) Field of Classification Search
CPC . B21D 7/02; B21D 7/022; B21D 7/03; B21D 7/06; B21D 7/08; B21D 43/003
See application file for complete search history.

(56) References Cited

U.S. PATENT DOCUMENTS

2002/0170329 A1* 11/2002 Ichiryu ..... B21D 7/025 72/166
2015/0139774 A1* 5/2015 Mantell ..... B23B 31/1261 414/816

FOREIGN PATENT DOCUMENTS

CN 111545608 A 8/2020
CN 215032978 U 12/2021
(Continued)

OTHER PUBLICATIONS

CN 107931416A, Jin et al. Apr. 2018.*
(Continued)

*Primary Examiner* — Edward T Tolan

(57) ABSTRACT

Disclosed is a free bending forming device having a variable length of a bending deformation zone (defined as A value) capable of processing tubes of different outer diameters, including a bending forming module, clamping and fixing modules and a spherical bearing. Clamping mechanisms of the bending forming module and the clamping and fixing modules possess integrated radial freedom of motion and circumferential freedom of motion of clamping jaws, meeting the requirements for clamping tubes with different outer diameters. Positions of arc-shaped limiting blocks and clamping support seats are adjusted through the clamping and fixing modules to change a magnitude of A value during the forming process. According to the present disclosure, the efficient "one-die-for-multiple-tubes" processing of the free
(Continued)

bending forming device for tubes is realized, saving the time and cost associated with die replacements.

11 Claims, 11 Drawing Sheets

(56) References Cited

FOREIGN PATENT DOCUMENTS

| | | | |
|---|---|---|---|
| CN | 114309183 | A | 4/2022 |
| CN | 115062505 | A | 9/2022 |
| CN | 117960863 | A | 5/2024 |
| EP | 1413369 | A1 | 4/2004 |

OTHER PUBLICATIONS

Translation CN 107931416A, Jin et al. Apr. 2018.*
CN 112453134A, Wu et al. Mar. 2021.*
115255069A, Sun Nov. 2022.*
CN 117259517A, Shu et al. Dec. 2023.*
CN 115193972A, Huang et al. Oct. 2022.*
Translation CN 115193972A, Huang et al. Oct. 2022.*
CN 113523045A, He et al. Oct. 2021.*

* cited by examiner

FREE BENDING FORMING DEVICE HAVING VARIABLE LENGTH OF BENDING DEFORMATION ZONE CAPABLE OF PROCESSING TUBES OF DIFFERENT OUTER DIAMETERS

TECHNICAL FIELD

The present disclosure belongs to the field of free bending forming of metal tubes, and specifically to a free bending forming device having a variable length of a bending deformation zone (defined as A value) capable of processing tubes of different outer diameters.

BACKGROUND

Metal bent tubes are one of the most common liquid transportation components in high-end manufacturing fields such as aerospace, automotive, and medical industries. Compared to traditional plane bending methods for tubes such as stretch bending, compression bending, and push bending, a tube free bending forming device has the advantages of flexibility, customization, and high efficiency, realizing the bending and twisting of tubes in three-dimensional space, thereby producing spatial bent tubes that meet diverse industrial requirements across various sectors.

Currently, the design and manufacturing of tube free bending forming devices have reached a mature stage. The most common three-axis free bending forming devices are widely adopted due to their operational simplicity. However, these devices typically follow a "one-mold-one-tube" processing mode, meaning a single device can only manufacture tubes with fixed dimensional specifications. To process tubes with different outer diameters, operators need to replace either the mold or the entire device, which leads to reduced production efficiency and increased manufacturing costs. Additionally, existing free bending forming devices lack the capability to adjust A value during tube processing. The A value determines the process design of the tube free bending forming device, significantly influencing both the forming quality of bent tubes and the application range of the device. To achieve "one-die-for-multiple-tubes" processing in tube free bending forming devices and enhance the forming performance of spatial bent tubes, thereby meeting related needs of both industry and academia, there is an urgent need to develop a free bending forming device having a variable A value that can clamp tubes of different outer diameters.

SUMMARY

To solve the problems in the background, the present disclosure provides a free bending forming device having a variable A value capable of processing tubes of different outer diameters. Tubes with different outer diameters can be clamped by adjusting radial positions and clamping statuses of clamping mechanisms within a bending forming module, and clamping and fixing modules. Meanwhile, an A value during the tube bending forming process is regulated by adjusting positions of arc-shaped limiting blocks and clamping support seats within the clamping and fixing modules.

The present disclosure employs the following technical solutions.

I. A Free Bending Forming Device Having a Variable a Value Capable of Processing Tubes of Different Outer Diameters A spherical bearing, a bending forming module and a plurality of clamping and fixing modules are included; the bending forming module is used for clamping a bent section of a tube blank, and adjusting radial positions of clamping mechanisms I and opening degrees of clamp jaws to realize the clamping of the tube blanks with different outer diameters; the bending forming module is fixed to the spherical bearing through a spherical fit, and an external hydraulic cylinder controls the movement of the spherical bearing, indirectly regulating the movement of the bending forming module; the plurality of clamping and fixing modules are arranged at a rear of the bending forming module and evenly distributed around a periphery of the tube blank in a circumferential manner, for clamping and limiting an unbent section of the tube blank; an arc-shaped limiting block of the clamping and fixing module is given a freedom of motion along a radial direction of the tube blank, and a clamping support seat of the clamping and fixing module possesses a freedom of motion along an axial direction of the tube blank; and by changing a radial position of the arc-shaped limit block and an axial position of the clamping support seat, an A value of the tube blank may be adjusted, regulating the bending forming quality of the tube blank.

The bending forming module includes a bending die housing, cross roller bearings, an external gear ring, a driving gear, a support disk, clamp-jaw support plates, and two groups of clamping mechanisms I; the support disk is mounted on a front side of the bending die housing, the external gear ring and the cross roller bearings are sequentially arranged between the support disk and the bending die housing, the support disk is fixedly connected to inner rings of the cross roller bearings, and outer rings of the external gear ring and the cross roller bearings are together mounted on the bending die housing; a gear motor is mounted on the support disk through a motor fixing plate, and an output shaft of the gear motor is connected to the driving gear meshed with the external gear ring; two ball screws are mounted on two sides of a front portion of the support disk through screw seats, two clamping-jaw support plates located at upper and lower portions are connected between the two ball screws, and the clamping-jaw support plates are arranged perpendicularly to the ball screws, and connected to the ball screws through screw nuts; sliding rails I are mounted on sides of the ball screws, two ends of each clamping-jaw support plate are mounted on the sliding rails I through sliding blocks I, and the degree of freedom of the clamping-jaw support plates in other directions is restricted by the cooperation of the sliding blocks I and the sliding rails I; screw rods of the ball screws are connected to output shafts of pulley motors through pulleys and synchronous belts; the pulley motors drive the ball screws to rotate, driving the screw nuts and the clamping-jaw support plates fixed thereon to move radially; a group of clamping mechanism I is fixed to a middle portion of each clamping-jaw support plate, and each group of clamping mechanism I includes a top block, a left clamping jaw and a right clamping jaw; and a radial position of the top block and opening degrees of the left clamping jaw and the right clamping jaw may be adjusted to clamp the tube blanks with different outer diameters.

The left clamping jaw and the right clamping jaw of the clamping mechanism I are fixed to the middle portion of the clamping-jaw support plate through the top block; the left clamping jaw and the right clamping jaw together form a variable-angle V-shaped structure, and the two are interconnected through toothed structures with same modules at root portions for coordinated movement; through holes are disposed at middle portions of the root portions of the left clamping jaw and the right clamping jaw; an output shaft of a clamping-jaw motor sequentially passes through the clamping-jaw support plate and the top block, extending into the through hole of the right clamp jaw, upper and lower corresponding pin grooves are disposed on the through hole of the right clamp jaw and the output shaft of the clamping-jaw motor, and a pin is embedded into the upper and lower pin grooves to make connection between the right clamp jaw and the output shaft of the clamping-jaw motor; the pin is in a transition fit with the through hole of the right clamping jaw and the pin groove on the output shaft of the clamping-jaw motor; a clamping-jaw shaft sequentially passes through the clamping-jaw support plate and the top block, extending out from the through hole of the left clamp jaw, and a clamping spring sleeved on the clamping-jaw shaft is mounted at a front portion of the left clamping jaw to axially limit the left clamping jaw; and thrust bearings sleeved on the clamping-jaw shaft and the output shaft of the clamping-jaw motor are arranged between the clamping jaws and the top block to eliminate the friction effect between parts caused by rotating motion; and the clamping-jaw motors directly drive the right clamping jaws, and the left clamping jaws rotate in opposite directions relative to the right clamping jaws through the toothed structures.

The inner rings and the outer rings of the cross roller bearings can rotate relative to each other; under the condition that the external gear ring is fixed to the bending die housing, the driving gear is driven to rotate around the external gear ring, while driving the support disk and the clamping mechanisms mounted thereon to generate circumferential movement relative to the bending die housing; and during the processing, the driving gear rotates to maintain a line connecting centerlines of the two groups of clamping mechanisms I in constant alignment with a bending radius of the tube blank.

An inner surface of the spherical bearing and an outer surface of the bending die housing are spherical surfaces compatible with each other; upper and lower symmetrical circular limiting columns are arranged on the outer surface of the bending die housing, and rectangular through grooves are disposed on the inner surface of the spherical bearing at positions corresponding to the upper and lower circular limiting columns; and the circumferential rotation of the bending die housing relative to the spherical bearing is restricted by the cooperation of the circular limiting columns and the rectangular through grooves, preventing the bending die housing from rotating in the opposite direction while the driving gear drives the support disk to rotate.

The clamping and fixing module includes a cylinder connecting rod, a clamping support seat, an arc-shaped limiting block, a main transmission shaft, a top rod, and a plurality of clamping mechanisms II similar to the bending forming module; the plurality of clamping mechanisms II are mounted at equal intervals along the axial direction of the tube blank on an inner surface of the clamping support seat through the main transmission shaft; the clamping mechanisms II are mounted on the inner surface of the clamping support seat through the top block, with same structures as the clamping mechanisms I, and all right clamping jaws of the clamping mechanisms II are collectively driven by the main transmission shaft, and the main transmission shaft is driven by a driving shaft motor and a coupling; the main transmission shaft drives the right clamping jaws to rotate, causing the left clamping jaws meshed with the right clamping jaws to rotate in opposite directions; the cylinder connecting rod moving relative to the clamping support seat is mounted on an outer surface of the clamping support seat, the two are connected though a sliding rail II and sliding blocks II, and there is a relative freedom of motion along the axial direction of the tube blank between the cylinder connecting rod and the clamping support seat; an end of the cylinder connecting rod is connected to an end of the clamping support seat through an electric push rod, a front end of the electric push rod is mounted on a mounting seat fixed to the end of the clamping support seat through an electric push rod shaft, and the clamping support seat is controlled to slide back and forth along the cylinder connecting rod through the electric push rod; the cylinder connecting rod is connected to a plurality of external cylinders uniformly distributed along the axial direction of the tube blank; and through the extension and retraction of the cylinders, the entire clamping and fixing module is driven to move along the radial direction of the tube blank, changing the radial position of the clamping and fixing module, and realizing the clamping and limiting of the tube blanks with different outer diameters.

The arc-shaped limiting block is arranged at a front end of the clamping support seat through the top rod; a mounting groove is disposed at a bottom of the arc-shaped limiting block, a top end of the top rod is embedded in the mounting groove, and a bottom end of the top rod is threadedly connected to the clamping support seat; a sliding block III is arranged at a tail portion of the arc-shaped limiting block, a radial movement of the sliding block III is realized through the cooperation with a sliding rail III on the clamping support seat, and the degree of freedom of the arc-shaped limiting block in other directions is restricted; and a threaded insertion depth of the top rod on the clamping support seat is adjusted to change the radial position of the arc-shaped limiting block, causing a curved surface of the arc-shaped limiting block to be abutted against an inner conical surface of the bending die housing. An inner surface of the bending die housing extends backward, forming an inner conical surface with a gradually increasing inner diameter.

The A value, which represents an axial distance from a front end of the foremost clamping jaw in the clamping and fixing module to a center of the top block in the bending forming module; and the adjustment of A value during the tube bending process is realized by regulating radial positions of the arc-shaped limiting blocks and axial positions of the clamping support seats.

The clamping jaws of the two groups of clamping mechanisms I in the bending forming module are staggered along the axial direction of the tube blank to prevent mutual interference during clamping; and the clamping jaws of the plurality of clamping mechanisms II on the plurality of clamping and fixing modules are staggered along the axial direction of the tube blank to avoid interference during clamping.

II. An Operating Method for the Free Bending Forming Device Having a Variable a Value Capable of Processing Tubes of Different Outer Diameters Includes the steps of.

S1, placing a tube blank in a position to be processed, controlling cylinders to cause top blocks of clamping and fixing modules to contact an outer surface of the tube blank, determining an A value during the processing, adjusting electric push rods and top rods to control arc-shaped limiting blocks for reaching a position corresponding to the selected A value, driving all left clamping jaws and right clamping jaws of the clamping and fixing modules through transmission shaft motors to clamp the tube blank, and fixing an unbent section of the tube blank;

S2, driving screw nuts to move in a radial direction through pulley motors, causing the top blocks of bending forming module to contact the outer surface of the tube blank, controlling the left clamping jaws and the right clamping jaws of upper and lower clamping mechanisms by clamping-jaw motors to fully clamp the tube blank, and preparing for bending;

S3, controlling a translational movement of spherical bearing through external hydraulic cylinders during the bending and forming, and indirectly controlling the movement of the bending forming module to a specified position to satisfy a requirement of bending radius for the tube blank; and ensuring controllable motion trajectories of the bending forming module through the contact between a bending die housing and the arc-shaped limiting blocks, controlling a driving gear to rotate by a gear motor when a bending radius of the tube blank deviates from an original bending plane, to achieve circumferential rotation of clamping mechanisms in the bending forming module, and ensuring that two groups of clamping mechanisms I remain positioned at an outermost convex side and an innermost concave side of the tube blank throughout the bending process; and S4, sequentially releasing the clamping mechanisms of the bending forming module and the clamping and fixing modules after the processing is completed, removing a formed tube from a front of the bending forming module, and adjusting an A value and returning to S1 to continue the processing if a forming quality is not satisfactory.

By adjusting the positions of the clamping mechanisms of the bending forming module and the clamping and fixing modules, a single bending device is capable of processing the tube blanks with different outer diameters; and by regulating radial positions of the arc-shaped limiting blocks and axial positions of clamping support seats, a magnitude of A value during the bending forming process of the tube blank is controlled.

The present disclosure has the following beneficial effects.

(1) In the present disclosure, by adjusting the positions and clamping statuses of the clamping mechanisms within the bending forming module and the clamping and fixing modules, the free bending forming device for tubes can achieve "one-die-for-multiple-tubes" processing, saving the time and resources, reducing costs and improving production efficiency.

(2) In the present disclosure, the A value during the free bending forming process of tubes can be adjusted by regulating the radial positions of the arc-shaped limiting blocks and the axial positions of the clamping support seats. The A value directly influences both the calculation of motion trajectories of the entire device and the bending formability of tubes. The adjustment of A value can expand the applicable scope of the device, while enhancing the forming quality of spatial bent tubes.

(3) In the present disclosure, the freedom of motion of the bending forming module around the tube in a circumferential direction is restricted by the circular limiting columns of the bending die housing, ensuring more accuracy and controllable motion trajectories during the processing, thereby achieving enhanced processing stability.

BRIEF DESCRIPTION OF THE DRAWINGS

FIG. 3(*b*) is a side view of the bending forming module; and FIG. 3(*c*) is a cross-sectional view of the bending forming module.

FIG. 7(*b*) is a cross-sectional view of the arc-shaped limiting block and the top rod; and FIG. 7(*c*) is a rear view of the arc-shaped limiting block.

FIG. 8(*b*) is a schematic diagram showing a status in which another tube of a different outer diameter is clamped according to the present disclosure.

FIG. 9(*b*) is a schematic diagram showing a status in which an A value is adjusted under the same condition as the outer diameter of the tube in FIG. 9(*a*) according to the present disclosure.

Figure 1:
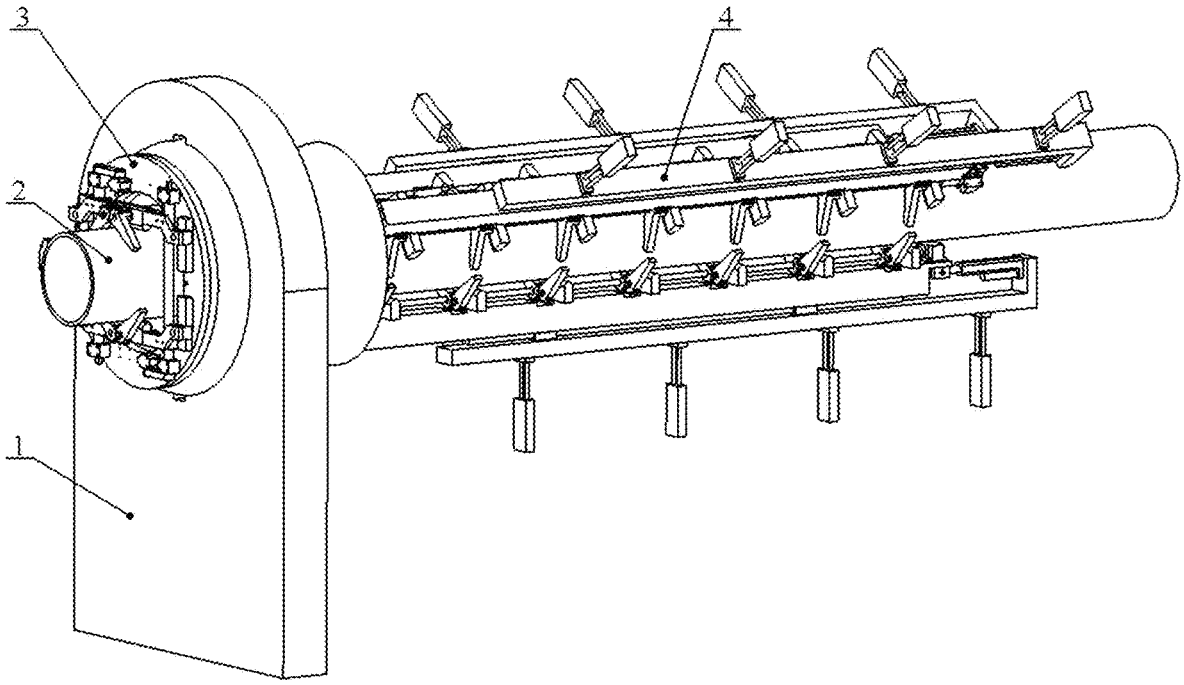
FIG. 1 is an overall schematic diagram according to the present disclosure.

Reference numerals and denotations thereof. 1—spherical bearing; 2—tube blank; 3—bending forming module; 4—clamping and fixing module; 5—pulley; 6—screw seat; 7—synchronous belt; 8—pulley motor; 9—ball screw; 10—clamping-jaw support plate; 11—sliding rail I; 12—sliding block I; 13—left clamping jaw; 14—screw nut; 15—clamping-jaw shaft; 16—clamping spring; 17—pin; 18—top block; 19—clamping-jaw motor; 20—right clamping jaw; 21—driving gear; 22—gear motor; 23—motor fixing plate; 24—thrust bearing; 25—support disk; 26—bending die housing; 27—external gear ring; 28—cross roller bearing; 29—top rod; 30—arc-shaped limiting block; 31—sliding block III; 32—sliding rail III; 33—clamping support seat; 34—sliding rail II; 35—sliding block II; 36—cylinder; 37—cylinder connecting rod; 38—electric push rod; 39—mounting seat; 40—electric push rod shaft; 41—driving shaft motor; 42—coupling; and 43—main transmission shaft.

DETAILED DESCRIPTION

The present disclosure is further described in detail below in combination with the accompanying drawings and specific embodiments.

Figure 2:
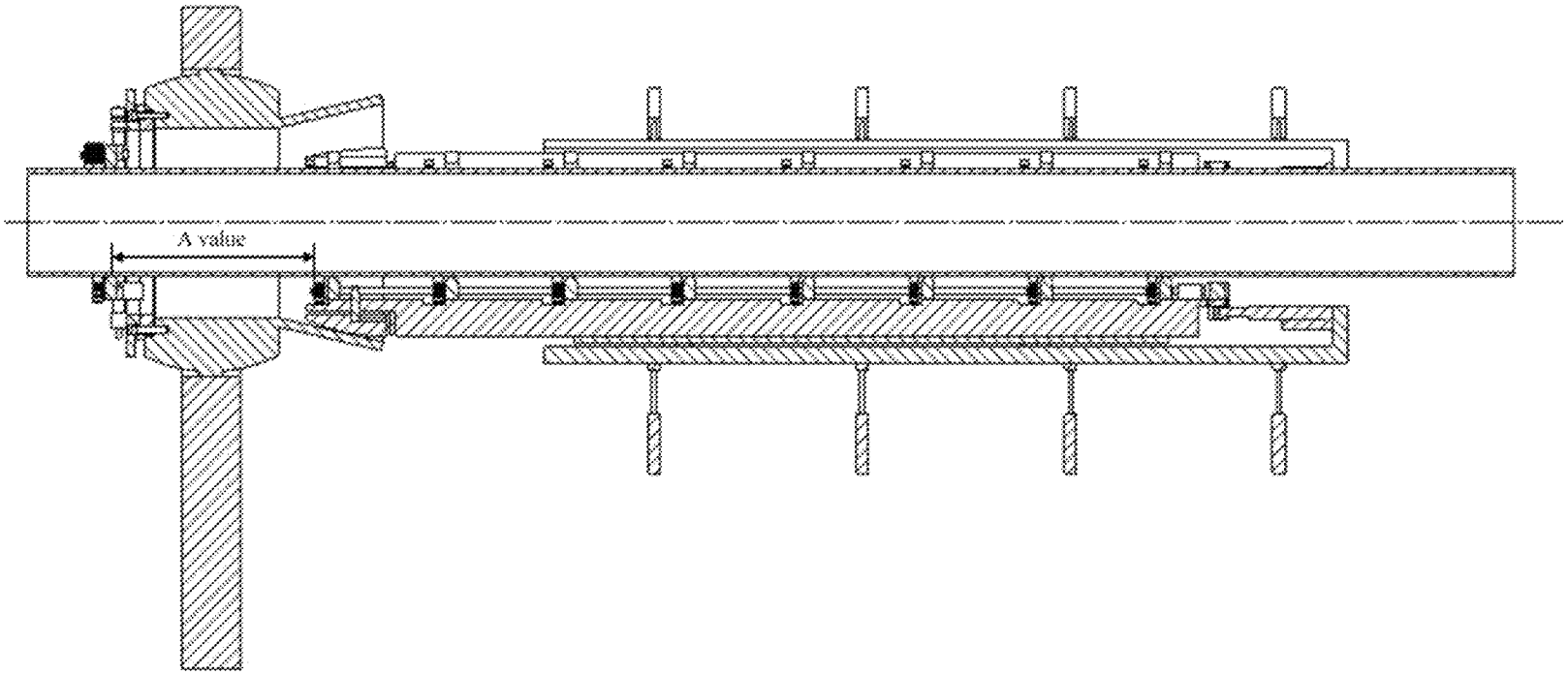
FIG. 2 is a side cross-sectional view according to the present disclosure.

Referring to FIGS. 1-2, a free bending forming device having a variable A value capable of processing tubes of different outer diameters includes a spherical bearing 1, a bending forming module 3 and three clamping and fixing modules 4 evenly distributed around a circumferential direction of a tube, the bending forming module 3 is fixed to the spherical bearing 1 through a spherical contact, and external hydraulic cylinders can control a translational movement of the spherical bearing, while indirectly controlling the movement of the bending forming module 3. A rear end of the bending forming module 3 abuts against and is constrained by the clamping and fixing modules 4, thereby ensuring a controlled motion trajectory for the bending forming module 3. By adjusting positions and states of clamping mechanisms within both the bending forming module 3 and the clamping and fixing modules 4, tube blanks 2 with different outer diameters can be clamped.

Figure 3A:
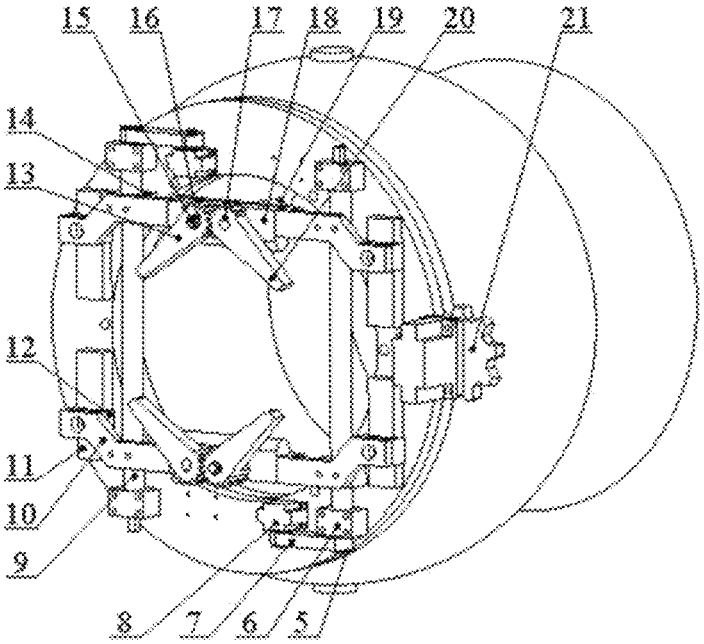
FIG. 3(*a*) is a schematic diagram of a bending forming module.
Figure 3B:
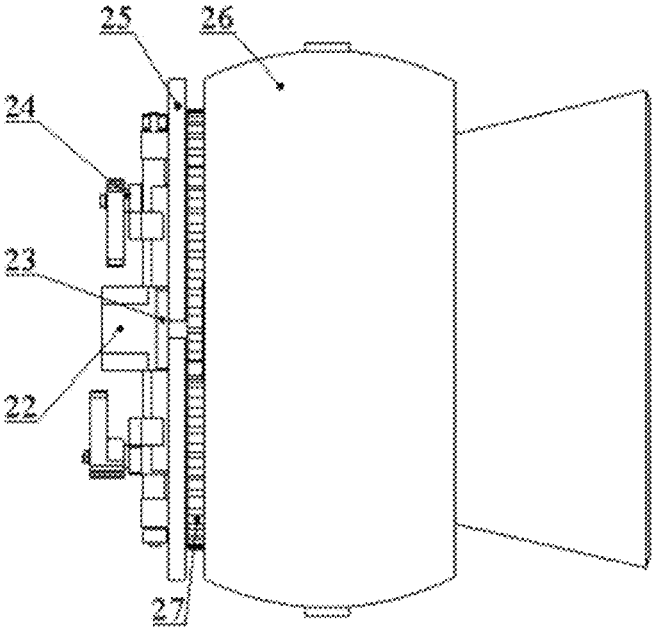
Figure 3C:
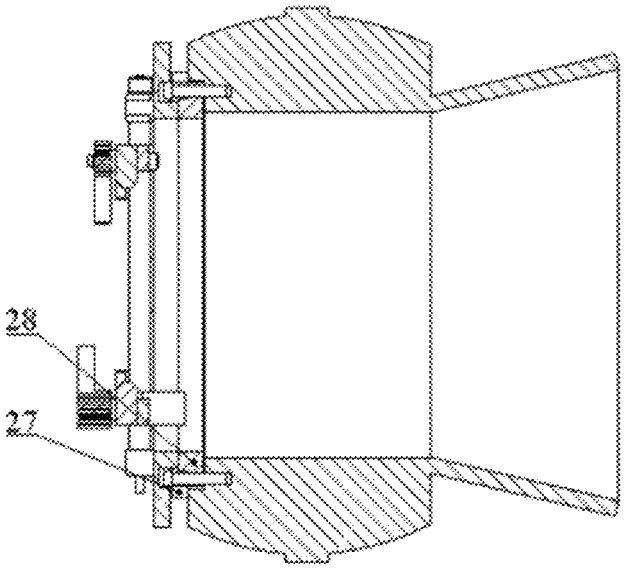

As shown in FIGS. 3(*a*), 3(*b*) and 3(*c*), the bending forming module 3 includes a bending die housing 26, cross roller bearings 28, an external gear ring 27, a support disk 25, a driving gear 21, clamp-jaw support plates 10, left clamping jaws 13, right clamping jaws 20 and top blocks 18, in which a clamping mechanism of the bending forming module 3 are formed by the left clamping jaw 13, the right clamping jaw 20, the top block 18, and the clamp-jaw support plate 10. The bending forming module 3 has two groups of symmetrically arranged clamping mechanism on the support disk 25, two ends of the clamping mechanisms are mounted on sliding rails I 11 through sliding blocks I 12, ball screws 9 and screw nuts 14 drive the entire clamping mechanism to move radially, and pulley motors 8, synchronous belts 7 and pulleys 5 drive the rotation of the ball screws 9. The support disk 25 is fixed to inner rings of the cross roller bearings 28, the external gear ring 27 and outer rings of the cross roller bearings 28 are mounted on the bending die housing 26, and the inner and outer rings of the cross roller bearings 28 can rotate relative to each other. With the outer rings of the cross roller bearings 28 held stationary, a gear motor 22 drives the driving gear 21 meshed with the external gear ring 27 to rotate, thereby driving the support disk 25 to rotate, further facilitating circumferential position adjustment of the two groups of clamping mechanism. To ensure that the bending die housing 26 does not rotate in the opposite direction due to reactive forces when the driving gear 21 rotates, a spherical section of the bending die housing 26 is equipped with symmetrically arranged circular limiting columns, and corresponding rectangular through grooves are disposed on the spherical bearing 1 matched with the circular limiting columns. Through the interaction between the circular limiting columns and the rectangular through grooves, the circumferential freedom of motion of the bending die housing 26 is restricted. During the processing, the driving gear 21 continuously rotates, which ensures that the two groups of clamping mechanisms remain positioned at an outermost convex side and an innermost concave side of the bending of the tube blank 2, i.e., a line connecting centerlines of the two groups of clamping mechanisms always coincides with a bending radius of the tube blank 2. To avoid interference between the clamping jaws of the two groups of clamping mechanisms during the clamping of the tube blank 2, the clamping jaws are axially staggered in their arrangement.

Figure 4A:
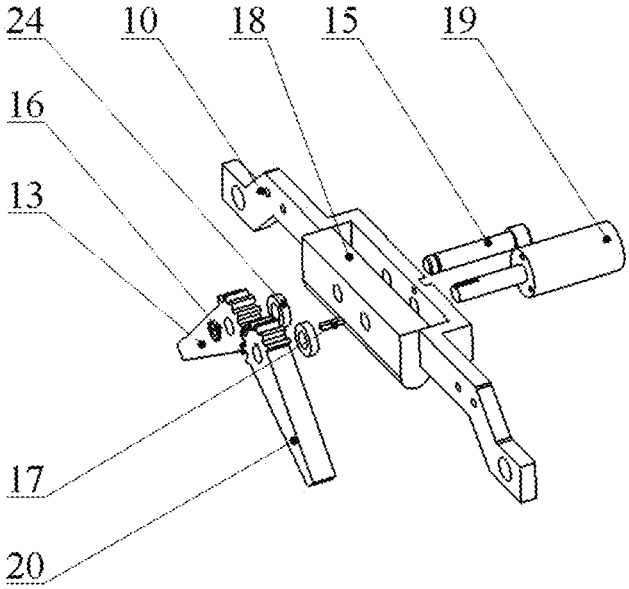
FIG. 4(*a*) is an exploded view of a clamping mechanism in the bending forming module, and FIG. 4(*b*) is a mounting schematic diagram of a clamping-jaw support plate in the bending forming module.
Figure 4B:
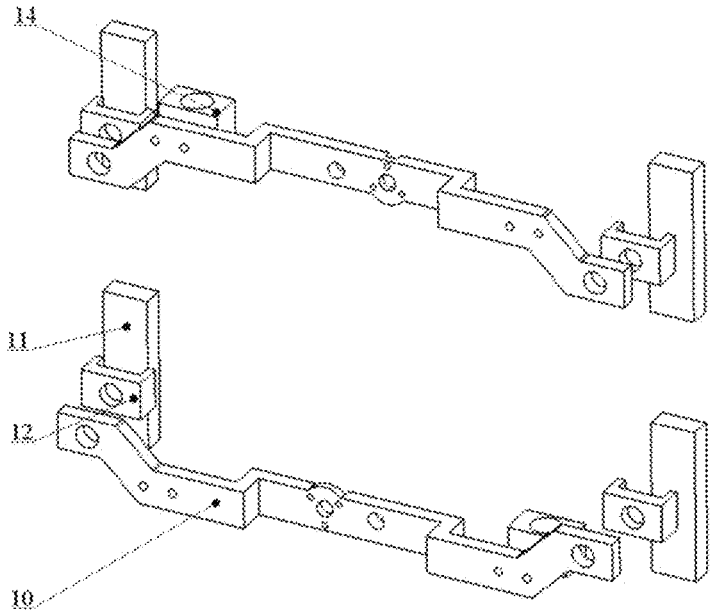

Referring to FIG. 4, a clamping-jaw shaft 15 sequentially passes through the clamping-jaw support plate 10, the top block 18, thrust bearings 24 and the left clamping jaw 13, assembling these components together. A clamping spring 16 is used for axially limiting the left clamping jaw 13, and the thrust bearings are used for eliminating the adverse effects of friction between the left clamping jaw 13 and the top block 18. The right clamping jaw 20 is directly mounted on a clamping-jaw motor 19, a pin groove is disposed at a motor port of the right clamping jaw 20 for a transition fit with a pin 17, allowing the transfer of rotational torque from the clamping-jaw motor 19. Toothed structures having the same modulus are located at root portions of the left clamping jaw 13 and the right clamping jaw 20, and the two are driven by meshing the toothed structures, achieving the clamping movement of the tube blank 2.

Figure 5:
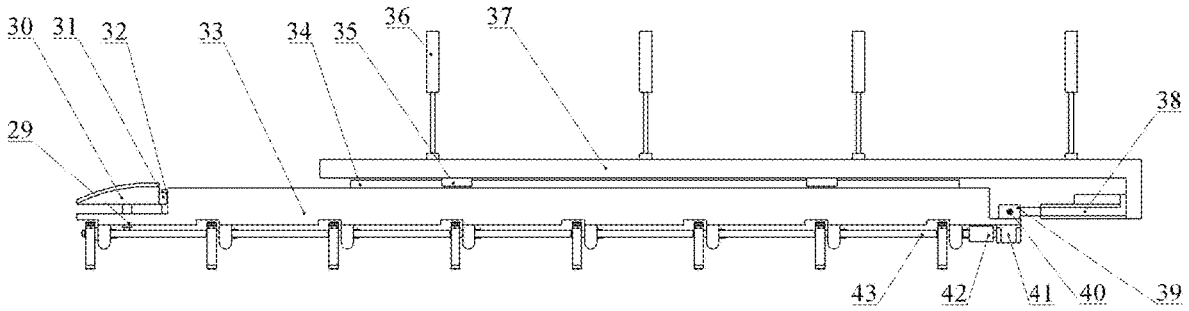
FIG. 5 is a schematic diagram of a clamping and fixing module according to the present disclosure.
Figure 6:
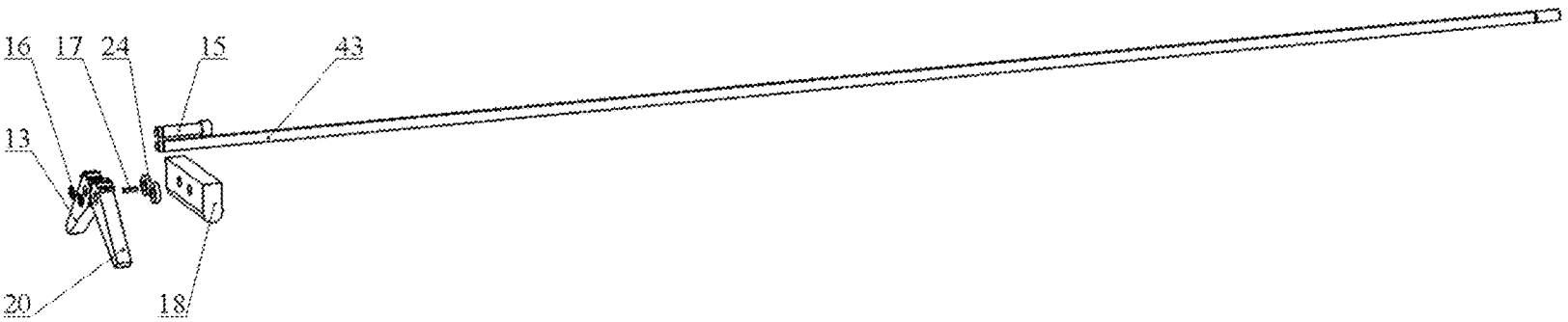
FIG. 6 is an exploded view of a clamping mechanism in the clamping and fixing module.
Figure 7A:
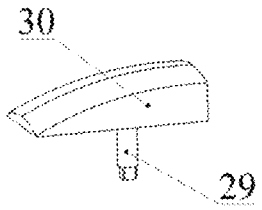
FIG. 7(*a*) is a schematic diagram of an arc-shaped limiting block and a top rod.
Figure 7B:
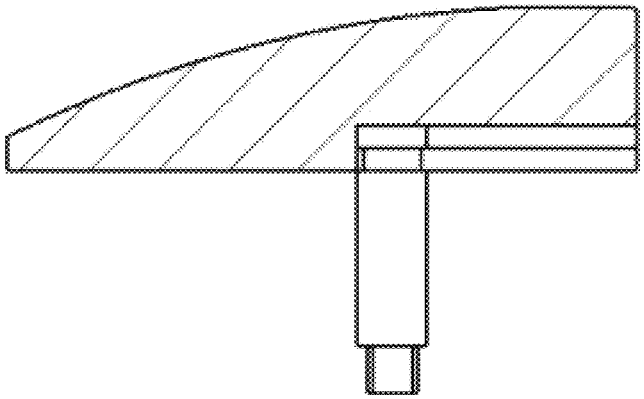
Figure 7C:
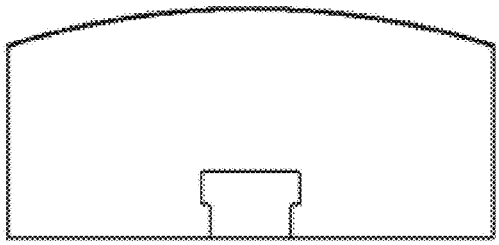

Referring to FIGS. 5-7, the clamping and fixing module 4 includes a cylinder connecting rod 37, a clamping support seat 33, an arc-shaped limiting block 30, a main transmission shaft 43, a top rod 29, and a plurality of clamping mechanisms II similar to the bending forming module 3; and the plurality of clamping mechanisms of the clamping and fixing module 4 are evenly distributed along the axial direction of the tube blank 2, all right clamping jaws 20 of the clamping mechanisms are uniformly driven by the main transmission shaft 43, and the main transmission shaft 43 is connected to a driving shaft motor 41 through a coupling 42, thereby causing the driving shaft motor 41 to supply rotational power to the main transmission shaft 43. A cylinder connecting rod 37 is connected to external cylinders 36. By retracting and extending the cylinders 36, a radial position of the entire clamping and fixing module 4 can be controlled. A sliding rail II 34 is matched with sliding blocks II 35, causing an axial relative freedom of motion between the clamping support seat 33 and the cylinder connecting rod 37. The axial relative positions of the two are controlled by an electric push rod 38, the cylinder connecting rod 37 is mounted at a rear end of the electric push rod 38, and a front end is fixed to an electric push rod shaft 40, while the electric actuator shaft 40 is mounted together with a mounting seat 39 fixed on the clamping support seat 33. The arc-shaped limiting block 30 abuts against the bending die housing 26 to restrict the movement of the bending forming module 3. A mounting groove is disposed at a bottom of the arc-shaped limiting block 30 for the interaction with a top of the top rod 29. The top rod 29 is threadedly connected to the clamping support seat 33. By adjusting a threaded engagement depth of the top rod 29 in the clamping support seat 33, the radial position of the arc-shaped limiting block 30 can be regulated. Through a sliding block III 31, a tail portion of the arc-shaped limiting block 30 cooperates with a sliding rail III 32 to constrain degrees of freedom in all directions other than the radial direction, thereby ensuring the stability of the motion. By comprehensively considering the radial position of the arc-shaped limiting block 30 and the axial position of the clamping support block 33, the adjustment of A value during the processing can be realized.

Figure 8A:
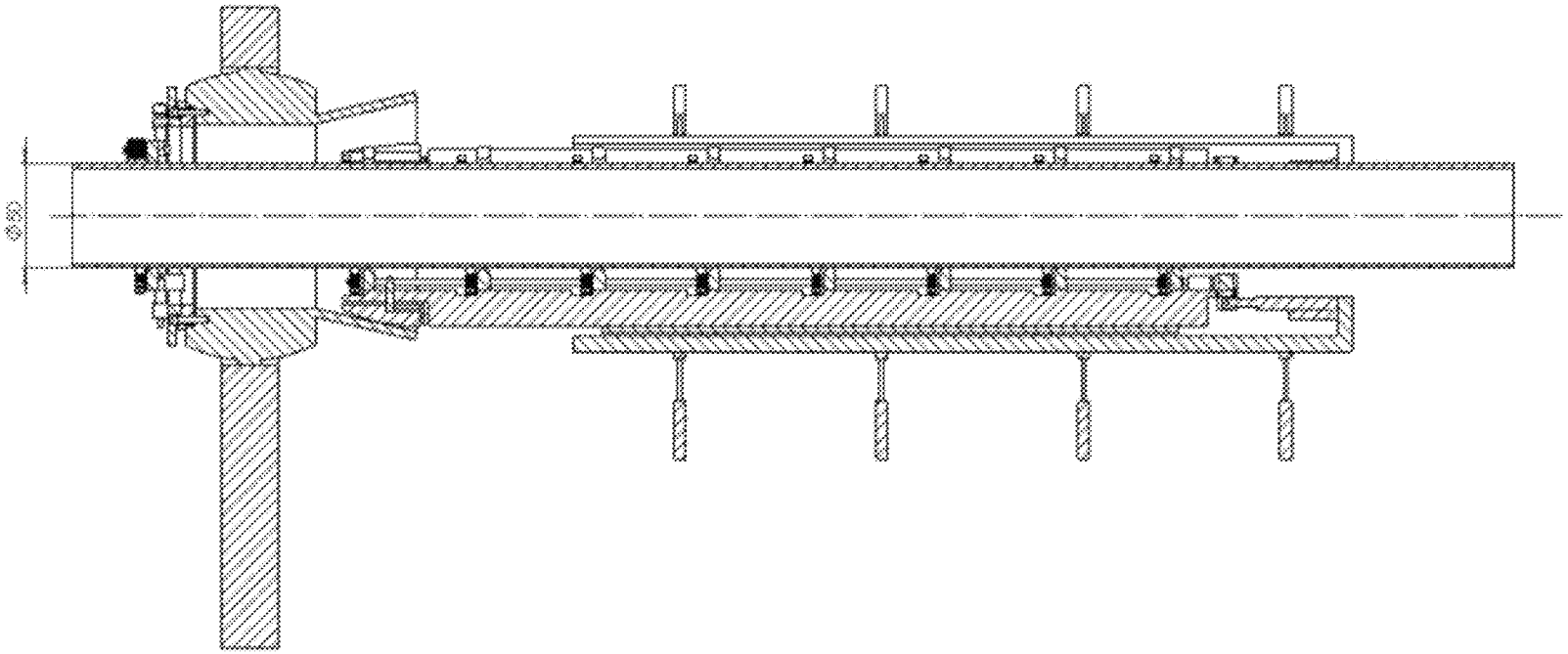
FIG. 8(*a*) is a schematic diagram showing a status in which one tube of an outer diameter is clamped according to the present disclosure.
Figure 8B:
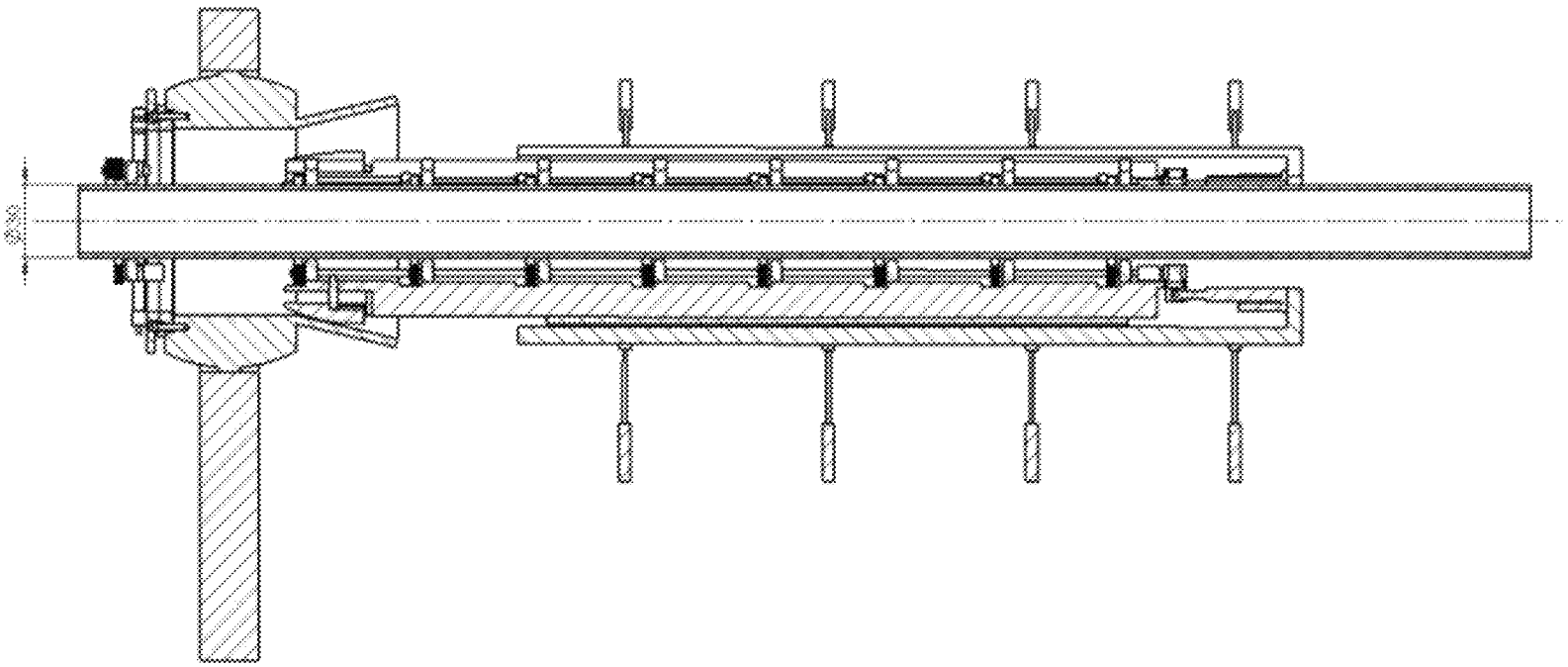

Referring to FIG. 8, when processing the tube blanks 2 with different outer diameters, the tube blank 2 is first placed in a position to be processed, the clamping mechanisms of the clamping and fixing modules 4 and the bending forming module 3 are sequentially controlled to approach and clamp the tube blank 2. Due to the varying outer diameters of the tube blank 2, extensions of the cylinders 36, radial positions of the screw nuts 14, and angles between the left clamping jaws 13 and the right clamping jaws 20 in the clamping mechanisms will all differ.

Figure 9A:
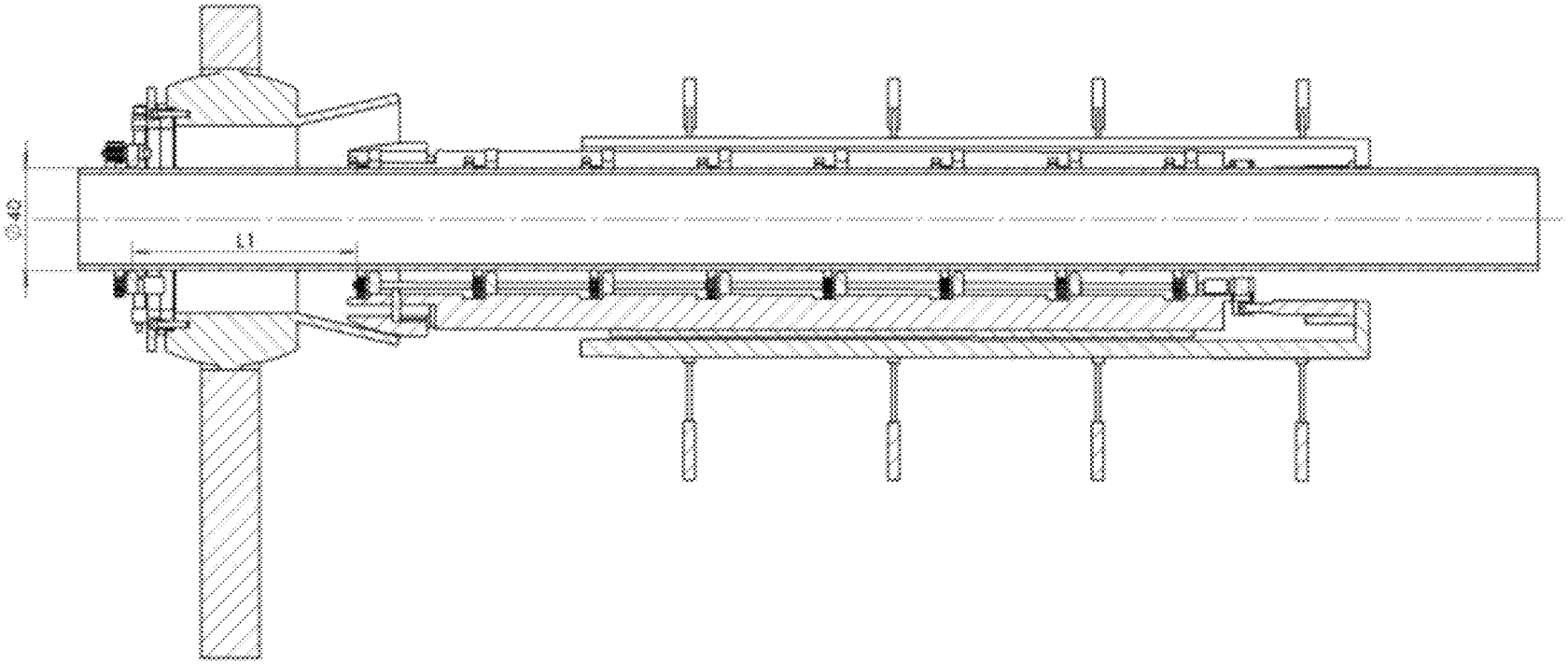
FIG. 9(*a*) is a schematic diagram showing a status in which an A value is adjusted when one tube is clamped according to the present disclosure.
Figure 9B:
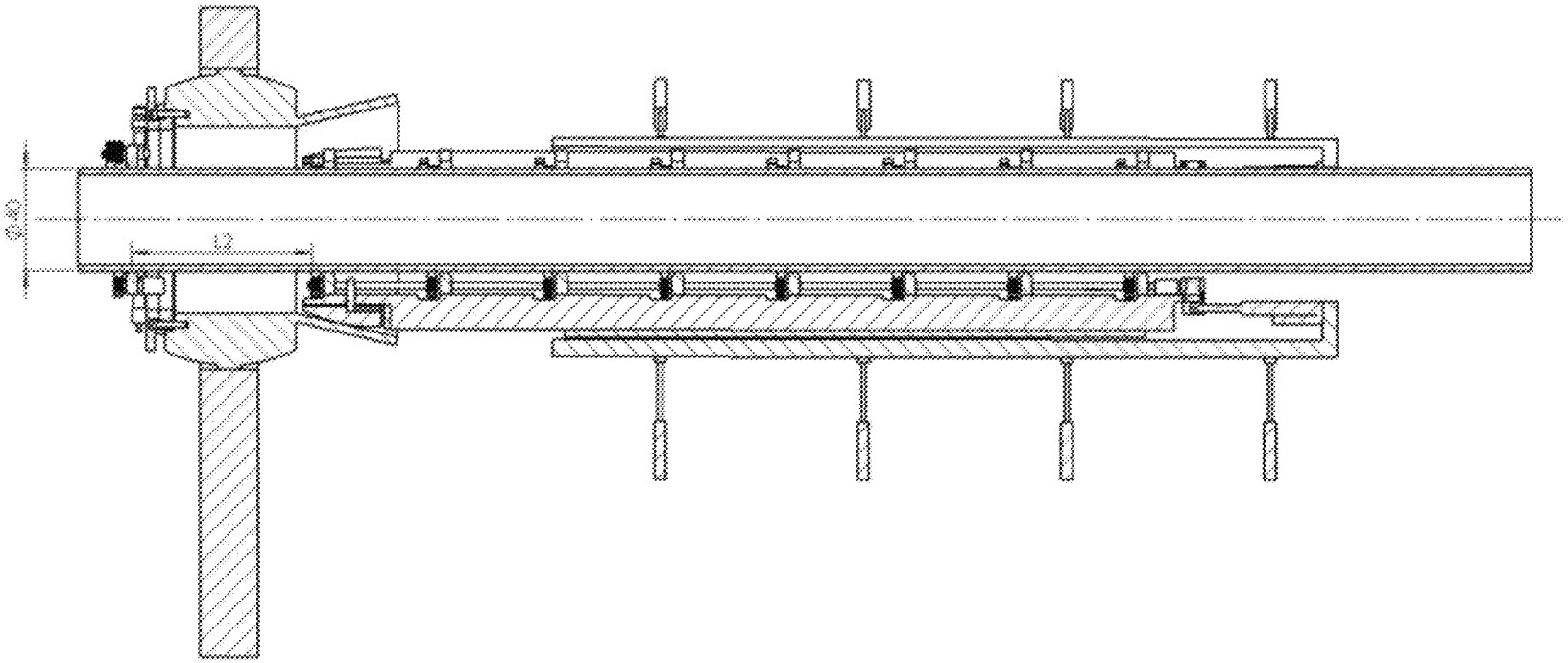

Referring to FIG. 9, under the condition that the outer diameter of the tube blank 2 remains unchanged, the A value during the processing can be altered by adjusting the radial positions of the arc-shaped limiting blocks 30 and the axial positions of the clamping support seats 33. Taking the reduction of A value as an example: assuming a current A value is L1 shown in FIG. 9(*a*), the A value is decreased, which is necessary to adjust the arc-shaped limiting blocks 30 inward along the radial direction while moving the clamping support seats 33 toward the bending die housing 26. In this way, the A value is changed into L2 in FIG. 9(*b*) is realized.

In (1), a tube blank 2 is placed in a position to be processed, piston rods of cylinders 36 are controlled to extend, causing top blocks 18 of all clamping mechanisms in clamping and fixing modules 4 to abut against an outer surface of the tube blank 2, an A value is selected for this processing, arc-shaped limit blocks 30 are controlled to reach a position corresponding to the selected A value through electric push rods 38 and top rods 29, all left clamping jaws 13 and right clamping jaws 20 in the clamping and fixing modules 4 are driven by driving shaft motors 41, while clamping the tube blank 2, thereby fixing an unbent section of the tube blank.

In (2), screw nuts 14 are driven to move in a radial direction through pulley motors 8, top blocks 18 of a bending forming module 3 are controlled to abut against the outer surface of the tube blank 2, and left clamping jaws 13 and right clamping jaws 20 of two groups of clamping mechanisms in a symmetrical arrangement are driven by two clamping-jaw motors 19, which can fully clamp the tube blank 2 in preparation for bending;

In (3), during the bending and forming, a translational movement of spherical bearing 1 is controlled through external hydraulic cylinders, to indirectly control the movement of the bending forming module 3 to a specified position, thereby satisfying a requirement of bending radius for the tube blank 2, and through the contact between a tail portion of bending die housing 26 and the arc-shaped limiting blocks 30, a controllable motion trajectory of the bending forming module is ensured. When a bending radius of the tube blank 2 deviates from an original bending plane, a driving gear 21 is controlled to rotate by a gear motor 22 to achieve circumferential rotation of the clamping mechanisms in the bending forming module 3, ensuring that two groups of clamping mechanisms remain positioned at an outermost convex side and an innermost concave side of the tube blank 2 throughout the bending process.

In (4), after the processing is completed, the clamping mechanisms of the bending forming module 3 and the clamping and fixing modules 4 are sequentially released, and a formed tube is removed from a front of the bending forming module 3. If it is necessary to adjust the processing to improve a bending quality of the tube, the steps (1)-(3) can be repeated to continue processing after adjusting the A value.

The invention claimed is:

1. A free bending forming device having a variable length of a bending deformation zone (defined as A value) capable of processing tubes of different outer diameters, comprising a spherical bearing (1), a bending forming module (3) and a plurality of clamping and fixing modules (4), wherein the bending forming module (3) is used for clamping a bent section of a tube blank (2), and adjusting radial positions of two groups of clamping mechanisms I and opening degrees of clamp jaws to clamp the tube blanks (2) with different outer diameters; and the bending forming module (3) is fixed to the spherical bearing (1) through a spherical fit, and an external hydraulic cylinder controls the movement of the spherical bearing (1), indirectly regulating the movement of the bending forming module (3); and the plurality of clamping and fixing modules (4) are arranged at a rear of the bending forming module (3) and evenly distributed around a periphery of the tube blank (8) in a circumferential manner, for clamping and limiting an unbent section of the tube blank (2); an arc-shaped limiting block (30) of the clamping and fixing module (4) is given a freedom of motion along a radial direction of the tube blank (2), and a clamping support seat (33) of the clamping and fixing module (4) possesses a freedom of motion along an axial direction of the tube blank (2); and by changing a radial position of the arc-shaped limiting block (30) and an axial position of the clamping support seat (33), the A value of the tube blank (2) may be adjusted, regulating the bending forming quality of the tube blank (2), and wherein the bending forming module (3) comprises a bending die housing (26), cross roller bearings (28), an external gear ring (27), a driving gear (21), a support disk (25), clamp-jaw support plates (10), and the two groups of clamping mechanisms I;

the support disk (25) is mounted on a front side of the bending die housing (26), the external gear ring (27) and the cross roller bearings (28) are sequentially arranged between the support disk (25) and the bending die housing (26), the support disk (25) is fixedly connected to inner rings of the cross roller bearings (28), and outer rings of the external gear ring (27) and the cross roller bearings (28) are together mounted on the bending die housing (26); and a gear motor (22) is mounted on the support disk (25) through a motor fixing plate (23), and an output shaft of the gear motor (22) is connected to the driving gear (21) meshed with the external gear ring (27);

two ball screws (9) are mounted on two sides of a front portion of the support disk (25) through screw seats (6), two clamping-jaw support plates (10) located at upper and lower portions are connected between the two ball screws (9), and the clamping-jaw support plates (10) are arranged perpendicularly to the ball screws, and connected to the ball screws (9) through screw nuts (14); and sliding rails I (11) are mounted on sides of the ball screws (9), and two ends of each clamping-jaw support plate (10) are mounted on the sliding rails I (11) through sliding blocks I (12);

screw rods of the ball screws (9) are connected to output shafts of pulley motors (8) through pulleys (5) and synchronous belts (7); and the pulley motors (8) drive the ball screws (9) to rotate, driving the screw nuts (14) and the clamping-jaw support plates (10) fixed thereon to move radially; and a group of the two groups of clamping mechanisms I is fixed to a middle portion of each clamping-jaw support plate (10), and each group of the two groups of clamping mechanisms I comprises a top block (18), a left clamping jaw (13) and a right clamping jaw (20); and a radial position of the top block (18) and opening degrees of the left clamping jaw (13) and the right clamping jaw (20) may be adjusted to clamp the tube blanks (8) with different outer diameters.

2. The free bending forming device having a variable A value capable of processing tubes of different outer diameters according to claim 1, wherein the left clamping jaw (13) and the right clamping jaw (20) of each group of the two groups of clamping mechanisms I are fixed to the middle portion of the clamping-jaw support plate (10) through the top block (18); the left clamping jaw (13) and the right clamping jaw (20) together form a variable-angle V-shaped structure, and the two are interconnected through toothed structures with same modules at root portions for coordinated movement; and through holes are disposed at middle portions of the root portions of the left clamping jaw (13) and the right clamping jaw (20);

an output shaft of a clamping-jaw motor (19) sequentially passes through the clamping-jaw support plate (10) and the top block (18), extending into the through hole of the right clamp jaw (20), upper and lower corresponding pin grooves are disposed on the through hole of the right clamp jaw (20) and the output shaft of the clamping-jaw motor (19), and a pin (17) is embedded into the upper and lower pin grooves to make connection between the right clamp jaw (20) and the output shaft of the clamping-jaw motor (19); a clamping-jaw shaft (15) sequentially passes through the clamping-jaw support plate (10) and the top block (18), extending out from the through hole of the left clamp jaw (13), and a clamping spring (16) sleeved on the clamping-jaw shaft (15) is mounted at a front portion of the left clamping jaw (13) to axially limit the left clamping jaw (13); and thrust bearings (24) sleeved on the clamping-jaw shaft (15) and the output shaft of the clamping-jaw motor (19) are arranged between the clamping jaws and the top block (18); and the clamping-jaw motors (19) directly drive the right clamping jaws (20), and the left clamping jaws (13) rotate in opposite directions relative to the right clamping jaws (20) through the toothed structures.

3. The free bending forming device having a variable A value capable of processing tubes of different outer diameters according to claim 1, wherein the inner rings and the outer rings of the cross roller bearings (28) are capable of rotating relative to each other; and under the condition that the external gear ring (27) is fixed to the bending die housing (26), the driving gear (21) is driven to rotate around the external gear ring (27), while driving the support disk (25) and the two groups of clamping mechanisms I mounted thereon to generate circumferential movement relative to the bending die housing (26); and during the processing, the driving gear (21) rotates to maintain a line connecting centerlines of the two groups of clamping mechanisms I in constant alignment with a bending radius of the tube blank (2).

4. The free bending forming device having a variable A value capable of processing tubes of different outer diameters according to claim 1, wherein an inner surface of the spherical bearing (1) and an outer surface of the bending die housing (26) are spherical surfaces compatible with each other; upper and lower symmetrical circular limiting columns are arranged on the outer surface of the bending die housing (26), and rectangular through grooves are disposed on the inner surface of the spherical bearing (1) at positions corresponding to the upper and lower circular limiting columns; and the circumferential rotation of the bending die housing (26) relative to the spherical bearing (1) is restricted by the cooperation of the circular limiting columns and the rectangular through grooves, preventing the bending die housing (26) from rotating in the opposite direction while the driving gear (21) drives the support disk (25) to rotate.

5. The free bending forming device having a variable A value capable of processing tubes of different outer diameters according to claim 1, wherein the clamping and fixing module (4) comprises a cylinder connecting rod (37), a clamping support seat (33), an arc-shaped limiting block (30), a main transmission shaft (43), a top rod (29), and a plurality of clamping mechanisms II;

the plurality of clamping mechanisms II are mounted at equal intervals along the axial direction of the tube blank (8) on an inner surface of the clamping support seat (33) through the main transmission shaft (43); the plurality of clamping mechanisms II are mounted on the inner surface of the clamping support seat (33) through the top block (18), and all right clamping jaws (20) of the plurality of clamping mechanisms II are collectively driven by the main transmission shaft (43), and the main transmission shaft (43) is driven by a driving shaft motor (41) and a coupling (42); and the main transmission shaft (43) drives the right clamping jaws (20) to rotate, causing the left clamping jaws (13) meshed with the right clamping jaws (20) to rotate in opposite directions;

the cylinder connecting rod (37) moving relative to the clamping support seat (33) is mounted on an outer surface of the clamping support seat (33), and the two are connected though a sliding rail II (34) and sliding blocks II (35); and an end of the cylinder connecting rod (37) is connected to an end of the clamping support seat (33) through an electric push rod (38), a front end of the electric push rod (38) is mounted on a mounting seat (39) fixed to the end of the clamping support seat (33) through an electric push rod shaft (40), and the clamping support seat (33) is controlled to slide back and forth along the cylinder connecting rod (37) through the electric push rod (38);

the cylinder connecting rod (37) is connected to a plurality of external cylinders (36) uniformly distributed along the axial direction of the tube blank (8); and through the extension and retraction of the cylinders (36), the entire clamping and fixing module (4) is driven to move along a radial direction of the tube blank (8), changing the radial position of the clamping and fixing module (4), and to clamp and limit the tube blanks (8) with different outer diameters; and the arc-shaped limiting block (30) is arranged at a front end of the clamping support seat (33) through the top rod (29); a mounting groove is disposed at a bottom of the arc-shaped limiting block (30), a top end of the top rod (29) is embedded in the mounting groove, and a bottom end of the top rod (29) is threadedly connected to the clamping support seat (33); a sliding block III (31) is arranged at a tail portion of the arc-shaped limiting block (30), a radial movement of the sliding block III (31) is radially moved through the cooperation with a sliding rail III (32) on the clamping support seat (33), and the degree of freedom of the arc-shaped limiting block (30) in other directions is restricted; and a threaded insertion depth of the top rod (29) on the clamping support seat (33) is adjusted to change the radial position of the arc-shaped limiting block (30), causing a curved surface of the arc-shaped limiting block (30) to be abutted against an inner conical surface of the bending die housing (26).

6. The free bending forming device having a variable A value capable of processing tubes of different outer diameters according to claim 5, wherein the A value represents an axial distance from a front end of the foremost clamping jaw in the clamping and fixing module to a center of the top block in the bending forming module; and the A value during the tube bending process is adjusted by regulating radial positions of the arc-shaped limiting blocks (30) and axial positions of the clamping support seats (33).

7. The free bending forming device having a variable A value capable of processing tubes of different outer diameters according to claim 2, wherein the clamping jaws of the two groups of clamping mechanisms I in the bending forming module (3) are staggered along the axial direction of the tube blank (8) to prevent mutual interference during clamping; and the clamping jaws of the plurality of clamping mechanisms II on the plurality of clamping and fixing modules (4) are staggered along the axial direction of the tube blank (8) to avoid interference during clamping.

8. The free bending forming device having a variable A value capable of processing tubes of different outer diameters according to claim 5, wherein the clamping jaws of the two groups of clamping mechanisms I in the bending forming module (3) are staggered along the axial direction of the tube blank (8) to prevent mutual interference during clamping; and the clamping jaws of the plurality of clamping mechanisms II on the plurality of clamping and fixing modules (4) are staggered along the axial direction of the tube blank (8) to avoid interference during clamping.

9. An operating method for the free bending forming device having a variable A value capable of processing tubes of different outer diameters according to claim 5, comprising the steps of:

S1, placing the tube blank (2) in a position to be processed, controlling the cylinders (36) to cause the top blocks (18) of the clamping and fixing modules (4) to contact an outer surface of the tube blank (2), determining the A value during the processing, adjusting the electric push rods (38) and the top rods (29) to control the arc-shaped limiting blocks (30) for reaching a position corresponding to the selected A value, driving all the left clamping jaws (13) and the right clamping jaws (20) of the clamping and fixing modules (4) through the transmission shaft motors (41) to clamp the tube blank (2), and fixing an unbent section of the tube blank (2);

S2, driving the screw nuts (14) to move in a radial direction through the pulley motors (8), causing the top blocks (18) of the bending forming module (3) to contact the outer surface of the tube blank (2), controlling the left clamping jaws (13) and the right clamping jaws (20) of upper and lower clamping mechanisms by the clamping-jaw motors (19) to fully clamp the tube blank (2), and preparing for bending;

S3, controlling a translational movement of the spherical bearing (1) through external hydraulic cylinders during the bending and forming, and indirectly controlling the movement of the bending forming module (3) to a specified position to satisfy a requirement of bending radius for the tube blank (2); and ensuring controllable motion trajectories of the bending forming module (3) through the contact between the bending die housing (26) and the arc-shaped limiting blocks (30), controlling the driving gear (21) to rotate by the gear motor (22) when a bending radius of the tube blank (2) deviates from an original bending plane, to achieve circumferential rotation of clamping mechanisms in the bending forming module (3), and ensuring that the two groups of clamping mechanisms I remain positioned at an outermost convex side and an innermost concave side of the tube blank (2) throughout the bending process; and S4, sequentially releasing the clamping mechanisms of the bending forming module (3) and the clamping and fixing modules (4) after the processing is completed, removing a formed tube from a front of the bending forming module (3), and adjusting the A value and returning to S1 to continue the processing if a forming quality is not satisfactory.

10. An operating method for the free bending forming device having a variable A value capable of processing tubes of different outer diameters according to claim 6, comprising the steps of:

S1, placing the tube blank (2) in a position to be processed, controlling the cylinders (36) to cause the top blocks (18) of the clamping and fixing modules (4) to contact an outer surface of the tube blank (2), determining the A value during the processing, adjusting the electric push rods (38) and the top rods (29) to control the arc-shaped limiting blocks (30) for reaching a position corresponding to the selected A value, driving all the left clamping jaws (13) and the right clamping jaws (20) of the clamping and fixing modules (4) through the transmission shaft motors (41) to clamp the tube blank (2), and fixing an unbent section of the tube blank (2);

S2, driving the screw nuts (14) to move in a radial direction through the pulley motors (8), causing the top blocks (18) of the bending forming module (3) to contact the outer surface of the tube blank (2), controlling the left clamping jaws (13) and the right clamping jaws (20) of upper and lower clamping mechanisms by the clamping-jaw motors (19) to fully clamp the tube blank (2), and preparing for bending;

S3, controlling a translational movement of the spherical bearing (1) through external hydraulic cylinders during the bending and forming, and indirectly controlling the movement of the bending forming module (3) to a specified position to satisfy a requirement of bending radius for the tube blank (2); and ensuring controllable motion trajectories of the bending forming module (3) through the contact between the bending die housing (26) and the arc-shaped limiting blocks (30), controlling the driving gear (21) to rotate by the gear motor (22) when a bending radius of the tube blank (2) deviates from an original bending plane, to achieve circumferential rotation of clamping mechanisms in the bending forming module (3), and ensuring that the two groups of clamping mechanisms I remain positioned at an outermost convex side and an innermost concave side of the tube blank (2) throughout the bending process; and S4, sequentially releasing the clamping mechanisms of the bending forming module (3) and the clamping and fixing modules (4) after the processing is completed, removing a formed tube from a front of the bending forming module (3), and adjusting the A value and returning to S1 to continue the processing if a forming quality is not satisfactory.

11. An operating method for the free bending forming device having a variable A value capable of processing tubes of different outer diameters according to claim 8, comprising the steps of:

S1, placing the tube blank (2) in a position to be processed, controlling the cylinders (36) to cause the top blocks (18) of the clamping and fixing modules (4) to contact an outer surface of the tube blank (2), determining the A value during the processing, adjusting the electric push rods (38) and the top rods (29) to control the arc-shaped limiting blocks (30) for reaching a position corresponding to the selected A value, driving all the left clamping jaws (13) and the right clamping jaws (20) of the clamping and fixing modules (4) through the transmission shaft motors (41) to clamp the tube blank (2), and fixing an unbent section of the tube blank (2);

S2, driving the screw nuts (14) to move in a radial direction through the pulley motors (8), causing the top blocks (18) of the bending forming module (3) to contact the outer surface of the tube blank (2), controlling the left clamping jaws (13) and the right clamping jaws (20) of upper and lower clamping mechanisms by the clamping-jaw motors (19) to fully clamp the tube blank (2), and preparing for bending;

S3, controlling a translational movement of the spherical bearing (1) through external hydraulic cylinders during the bending and forming, and indirectly controlling the movement of the bending forming module (3) to a specified position to satisfy a requirement of bending radius for the tube blank (2); and ensuring controllable motion trajectories of the bending forming module (3) through the contact between the bending die housing (26) and the arc-shaped limiting blocks (30), controlling the driving gear (21) to rotate by the gear motor (22) when a bending radius of the tube blank (2) deviates from an original bending plane, to achieve circumferential rotation of clamping mechanisms in the bending forming module (3), and ensuring that the two groups of clamping mechanisms I remain positioned at an outermost convex side and an innermost concave side of the tube blank (2) throughout the bending process; and S4, sequentially releasing the clamping mechanisms of the bending forming module (3) and the clamping and fixing modules (4) after the processing is completed, removing a formed tube from a front of the bending forming module (3), and adjusting the A value and returning to S1 to continue the processing if a forming quality is not satisfactory.

* * * * *